US010167701B2

(12) United States Patent
Williamson, Jr.

(10) Patent No.: US 10,167,701 B2
(45) Date of Patent: Jan. 1, 2019

(54) STANDING INJECTION VALVE WITH HYDRAULICALLY DAMPENED VALVE CLOSURE

(71) Applicant: Halliburton Energy Services, Inc., Houston, TX (US)

(72) Inventor: Jimmie Robert Williamson, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/784,714

(22) Filed: Oct. 16, 2017

(65) Prior Publication Data

US 2018/0038200 A1 Feb. 8, 2018

Related U.S. Application Data

(63) Continuation of application No. 14/440,306, filed as application No. PCT/US2014/038595 on May 19, 2014, now Pat. No. 9,822,606.

(51) Int. Cl.

| | |
|---|---|
| ***E21B 34/10*** | (2006.01) |
| ***E21B 34/06*** | (2006.01) |
| ***E21B 43/12*** | (2006.01) |

(52) U.S. Cl.

CPC ..... *E21B 34/10* (2013.01); *E21B 34/06* (2013.01); *E21B 34/101* (2013.01); *E21B 43/12* (2013.01); *E21B 43/128* (2013.01)

(58) Field of Classification Search

CPC ..... E21B 34/10; E21B 34/06; E21B 34/101; E21B 43/12; E21B 43/128; F16K 17/18

See application file for complete search history.

(56) References Cited

U.S. PATENT DOCUMENTS 4,391,328 A 7/1983 Aumann et al.
4,691,777 A 9/1987 Williamson et al.
(Continued)

FOREIGN PATENT DOCUMENTS

WO 0140613 6/2001

OTHER PUBLICATIONS

U.S. Appl. No. 14/440,306, Final Office Action, dated Apr. 24, 2017, 14 Pages.

(Continued)

*Primary Examiner* — Robert E Fuller
*Assistant Examiner* — Christopher J Sebesta
(74) *Attorney, Agent, or Firm* — Kilpatrick Townsend & Stockton LLP

(57) ABSTRACT

An injection valve assembly for use in a well, where pressurized gas or fluid from uphole in the well displaces a perforated valve head from a valve seat, allows for fluid flow of the pressurized gas or fluid into the valve head and further downhole in the well toward an electric submersible pump. A compression spring is coiled around a valve stem connected to the valve head, pushing the valve stem and valve head in an uphole direction opposite to the force from pressurized gas or fluid. The compression spring is in a chamber filled with hydraulic fluid, where the hydraulic fluid can pass through a dampening system assembly and a flow restrictor assembly, thereby regulating the speed at which the valve stem and valve head can move relative to the valve seat.

23 Claims, 8 Drawing Sheets

(56) References Cited

U.S. PATENT DOCUMENTS

| | | | | |
|---|---|---|---|---|
| 5,282,492 | A | 2/1994 | Angeli et al. | |
| 5,332,042 | A | 7/1994 | Walter et al. | |
| 5,865,261 | A * | 2/1999 | Cooper | E21B 21/08 175/205 |
| 6,029,758 | A | 2/2000 | Novacovicci et al. | |
| 6,289,990 | B1 | 9/2001 | Dillon et al. | |
| 2001/0032675 | A1 * | 10/2001 | Russell | F16K 17/18 137/493.9 |
| 2004/0000406 | A1 * | 1/2004 | Allamon | E21B 21/103 166/373 |
| 2009/0211814 | A1 | 8/2009 | de Boer | |
| 2010/0282476 | A1 * | 11/2010 | Tessier | E21B 34/08 166/373 |
| 2011/0168410 | A1 | 7/2011 | de Boer | |
| 2012/0205122 | A1 * | 8/2012 | Peter | E21B 21/10 166/373 |
| 2012/0227982 | A1 * | 9/2012 | Swietlik | E21B 21/10 166/373 |

OTHER PUBLICATIONS

U.S. Appl. No. 14/440,306, Non-Final Office Action dated Dec. 20, 2016, 15 pages.

U.S. Appl. No. 14/440,306, Notice of Allowance dated Jul. 19, 2017, 7 pages.

International Application No. PCT/US2014/038595, "International Search Report and Written Opinion", dated Feb. 12, 2015, 11 pages.

* cited by examiner

STANDING INJECTION VALVE WITH HYDRAULICALLY DAMPENED VALVE CLOSURE

CROSS REFERENCE TO RELATED APPLICATIONS

This is a continuation of U.S. patent application Ser. No. 14/440,306 titled "Standing Injection Valve with Hydraulically Dampened Valve Closure," filed May 1, 2015 (Allowed), which is a U.S. national phase under 35 U.S.C. 371 of International Patent Application No. PCT/US2014/038595, titled "Standing Injection Valve with Hydraulically Dampened Valve Closure," filed May 19, 2014, each of which is incorporated herein by reference in its entirety.

TECHNICAL FIELD

This disclosure relates to the actuation of valve structures utilized in hydrocarbon wells and other wells, as well as the actuation of valve structures in other extreme environments, and to a controlled opening and closing of such valves.

BACKGROUND

Electric submersible pumps (ESP) can be used within the tubing or casing structures deployed in a wellbore. An ESP can be used in some applications to mix a diluent into a wellbore to interact, mix with, and in part dilute natural petroleum, crude oil, gas, or other hydrocarbons located in the wellbore, making the hydrocarbons easier to pump out of the wellbore. An ESP, however, can stop functioning when deployed within a wellbore. In these situations, it can become necessary to efficiently cease providing diluent injection into the wellbore until the ESP is again functioning.

BRIEF DESCRIPTION OF THE DRAWINGS

Illustrative aspects are described in detail below with reference to the following drawing figures.

DETAILED DESCRIPTION

Figure 1A:
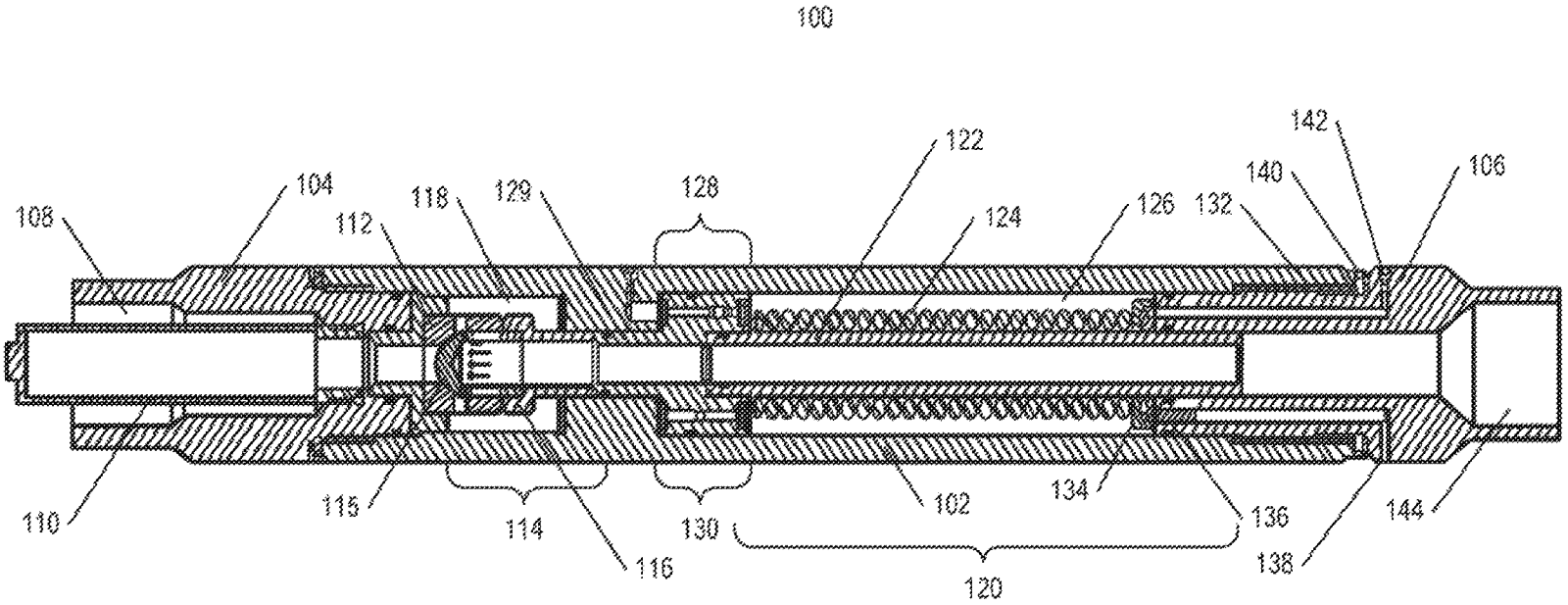
FIG. 1A is a cross-sectional schematic representing a standing injection valve with hydraulically dampened valve closure, according to some aspects of the present disclosure.

Certain aspects of the present disclosure relate to a standing injection valve assembly for use in a hydrocarbon well, where pressurized gases, solvents, dispersants, or chemical inhibitors pass through a conduit from the surface to displace a perforated valve head from a valve seat, and thereby allows for measured injection of the pressurized gases, solvents, dispersants, or chemical inhibitors into the valve head and further downhole in the well into a chamber with an electric submersible pump. A compression spring is coiled around a valve stem connected to the valve head, pushing the valve stem and valve head in an uphole direction opposite to the force from the injected gas or fluids. The compression spring is further housed within a chamber filled with hydraulic fluid, where the hydraulic fluid can pass through a dampening system assembly and a flow restrictor assembly coupled to the valve stem, thereby regulating the speed at which the valve stem and valve head can move relative to the valve seat.

In some wellbore applications, an electric submersible pump (ESP) can be used within a tubing or casing structure to increase well production and mix injected solvents, dispersants, or chemical inhibitors, into the well production fluids. The dilution of some petroleum fluids can improve the well performance and enhance the value of oil produced by the well. In some wells, asphaltene precipitation inhibitors are required to inhibit asphaltene deposition. Asphaltenes are comprised primarily of carbon, hydrogen, nitrogen, oxygen, and sulfur. Some asphaltenes have trace amounts of nickel and vanadium. Asphaltenes can be defined operationally as the insoluble n-heptane ($C_7H_{16}$). The injection of chemicals and diluent fluids can thin crude oil or other hydrocarbons, thereby making the relatively viscous crude oil thinner and easier to pump up toward the surface of the well. If an ESP is located one or two miles deep and it fails or stops functioning, reducing and stopping the delivery of diluent into the well efficiently and at a controlled rate can be advantageous to avoid wasting diluent. Further, the control of diluent delivered to an ESP can be advantageous to provide the desired amount of diluent in a well.

The illustrative examples discussed herein are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "uphole," "downhole," "inward," "outward," etc. in relation to the illustrative aspects as they are depicted in the figures, the uphole direction being toward the surface of the well, the downhole direction being toward the toe of the well, the inward direction being toward the longitudinal axis (or centerline) of the tool string, casing, or mandrel, and the outward direction being away from the longitudinal axis of the tool string, casing, or mandrel. Further, portions of structural elements described herein can be referred to by their uphole or downhole ends. Like the illustrative aspects, the numerals and directional descriptions included in the following sections should not be used to limit the present disclosure.

As further used herein, the term "poppet valve" refers to a valve structure that includes a valve seat that has an opening, configured to couple with a valve head that can plug the opening in the valve seat. A valve stem can extend from the valve head, such as by extending from a side of the valve head distal from the valve seat. In some aspects, the valve head can be tapered or otherwise shaped to conform and couple with the shape of the valve seat and opening. The motion of the valve head is generally perpendicular to the port defined by the valve seat and opening. In other aspects, the valve head and stem can be hollow and fluidly connected, where the valve head can be perforated with openings to allow for the flow of gas or fluid into the interior, hollow cavity of the valve head and valve stem. A compression spring, mechanically coupled to the valve stem, can apply force on the valve head pushing the valve head toward the valve seat (i.e., in the direction opposite to the displacement of the compression spring). In an alternative example, a force applied on the valve head in the uphole direction could be provided by a compressed gas charge or other gas source.

Examples of the standing injection valve disclosed herein can utilize a hydraulically dampened valve opening and closure structure configured to actuate (i.e., open or close) based upon a specified preset threshold differential pressure (i.e., from above to below) on the standing injection valve. In aspects, the standing injection valve is a poppet valve, where when deployed in a wellbore, the closed valve head has pressure applied to it from both the uphole and downhole directions. The specified preset threshold pressure of the standing injection valve can be equal to the hydrostatic pressure at the setting depth plus an additional pressure value, where the setting depth is a range of depths within a wellbore at which the standing injection valve is configured to be operated. The additional pressure value represents the pressure differential that must be overcome to open the standing injection valve. The pressure acting from uphole on the standing injection sealing diameter can be caused by gas, liquid, or combinations thereof supplied from the uphole end of the tubing connecting the standing injection valve to the surface. The pressure acting on the lower side of the standing injection valve sealing diameter can be from the hydrostatic pressure of the wellbore which can be reduced by the suction of the ESP. An upward force to close the standing injection valve can also come from a compression spring coiled around the valve body.

When the differential pressure between the uphole pressure and the downhole pressure across the standing injection valve exceeds the preset threshold pressure, an opening pressure can be reached, the standing injection valve can move in a downhole direction to further compress the compression spring, and the injection valve can open to allow gas or liquid injection into the well. In other words, when pressurized gas or fluid contacts the nose of the valve head, the poppet valve can begin to open if the force of the pressurized gas or fluid can overcome the spring resistance of the compression spring and hydrostatic pressure downhole of the valve. Downhole movement of the injection valve can begin to pass or leak pressure through openings in the valve seat into an injection valve chamber. The injection valve chamber can be sealed such that pressurized gas or fluid can only egress from the chamber through flow openings in the valve head, which can begin to be exposed as the standing injection valve poppet assembly moves in a downhole direction. After opening, the standing injection valve mechanism can allow for continuous injection of gas, liquid, or combination thereof through the variable choke of the standing injection valve structure by increasing or maintaining the uphole pressure above the opening pressure or decreasing the pressure below the standing injection with an ESP. Conversely, when the differential between the uphole pressure and the downhole pressure across the injection valve is less than a preset threshold pressure, a closing pressure can be reached, the injection valve can move in an uphole direction, and the injection valve can close to stop providing gas or liquid injection into the well.

The components of the injection valve, such as the valve seat, the valve head, and the valve stem, can be made of various materials. In one example, the components are made of tungsten carbide, which can provide for resistance against wear and can maximize the wear life of the components for pressurized gas or fluid injection.

The pressure drop through a fully opened poppet or injection valve can be adjustable within a designed range by sizing the maximum flow area through the flow openings that can perforate the valve head. Because the differential surface area of the flow openings in the valve head can increase as the poppet opens, the poppet can open and continue to move in a downhole direction until the pressure differential multiplied by the flow opening area of the poppet at the injection valve chamber seal diameter is equal to the upward force applied by the compression spring and hydrostatic pressure downhole of the poppet. In other examples, the poppet can continue to move in a downhole direction until a portion of the valve head assembly is physically blocked by a portion of the standing tube in which the poppet valve is housed.

The poppet valve may not be able to actuate to a fully open position at a rate that could damage the poppet valve because of the hydraulic dampening features, where in aspects the hydraulic dampening features can include a dampening piston. Movement of the poppet in the downhole direction can force hydraulic fluid flow through at least one check valve located in the dampening system piston. The check valves in the dampening system piston can close when downward movement is stopped to not allow for fluid flow in the downhole direction. While flow through the dampening system piston can be rapid, the presence of hydraulic fluid can limit fluid flow, and thereby generally prevent the solid surfaces of the injection valve assembly from moving and impacting with each other at potentially damaging speeds or forces.

The compression spring can apply force on the dampening system piston and the poppet in the uphole direction to close the injection valve, but the hydraulic fluid in the piston chamber first flows through a fluid restrictor for movement to occur. The fluid restrictor can be sized so that the closure rate of the poppet is restricted and hydraulically dampened. The hydraulic dampening of the closure movement can generally prevent the valve head from impacting the valve seat with a potentially damaging force when closing the injection valve. In some examples, the fluid restrictor hydraulically dampens the closure movement of the injection valve such that movement of the injection valve from a fully open position to a fully closed position involves about ten minutes. In other examples, the fluid restrictor hydraulically dampens the closure movement of the injection valve such that movement of the injection valve from a fully open position to a fully closed position takes about ten seconds. In other examples, the fluid restrictor hydraulically can dampen the closure movement of the injection valve such that movement of the injection valve from a fully open position to a fully closed position takes about ten minutes. In further examples, the fluid restrictor hydraulically can dampen the closure movement of the injection valve such that movement of the injection valve from a fully open position to a fully closed position takes from about ten seconds to about ten minutes.

The dampening action of both the fluid restrictor and the dampening system piston can further prevent valve chattering and can allow the flow rate of the injected fluid or gas to be precisely controlled through the poppet choke by adjusting the flow rate at the surface of the wellbore. Valve chatter is undesirable because such pressure pulses can lead to failure of a poppet valve seat and other associated downhole equipment, such as the ESP.

When the surface injection pressure of the injected fluid or gas is reduced below the preset threshold pressure, or the reduced pressure from the ESP is increased due to ESP failure, the injection valve can begin to close; in other words, as injection pressure decreases or the ESP fails decreasing the differential pressure, the restoring force of the compression spring can move the valve head in an uphole direction to close the poppet valve. When the differential pressure across the injection valve is sufficiently low, the valve head and valve seat can contact. The injection valve can be reset to a fully closed position. In the closed position, the injection valve can hold closed against hydrostatic pressure from uphole of the injection valve and may not open again unless a sufficient pressure differential is again applied.

When the injection valve is in an open position, diluent delivered into the injection valve assembly can further flow to, and be drawn downhole by suction from an ESP in fluid communication with the standing injection valve flow. Diluent delivered by the standing injection valve into a well can be routed to a position deeper than and below an ESP, thinning crude oil or other hydrocarbons, which can then be more easily pumped to the surface of the well. The ESP can mix and deliver a diluent into a production wellbore to dilute the crude oil in the production wellbore. In some examples, the diluted crude oil in the wellbore that is subsequently pumped out of the well can contain about 2% of a diluent. In other examples, the diluted crude oil in the wellbore that is subsequently pumped out of the well can contain about 5%, about 20%, or about 30% of a diluent.

FIG. 1A is a cross-sectional schematic representing one example of a standing valve with an injection valve and a hydraulically dampened valve closure 100. The standing injection valve housing 102 can mechanically couple with and secure to a standing valve top sub 104 at the uphole end of the standing injection valve housing 102, and can mechanically couple with and secure to a standing injection valve bottom sub 106 at the downhole end of the standing injection valve housing 102. The standing injection valve housing 102 can house an injection valve assembly having a valve seat 112 and valve head 114 located within an injection valve chamber 118, the injection valve chamber 118 being a hollow interior region of the housing 102. In aspects, the valve head 114 can have a valve head nose 115 and a valve head neck 116, where the valve head neck 116 can mechanically couple the valve head 114 to an interior surface or diameter of the housing 102. The valve head 114 can be perforated with openings that allow for the passage of gas or fluid from the injection valve chamber 118 into the hollow interior of the valve head 114. A valve stem 120 can extend from the end of the valve head 114 opposite to the valve seat 112, where the valve stem 120 can be in part defined by a valve stem mandrel 122 that can mechanically couple the valve stem 120 to an interior surface or diameter of the standing injection valve housing 102. The valve stem 120 has a hollow interior that is in fluid communication with the hollow interior of the valve head 114. The valve stem 120 extends into a compression spring chamber 126, in which a compression spring 124 can coil around the valve stem mandrel 122 and provide a force on the injection valve assembly in the uphole direction, corresponding and opposite to a deflection of the compression spring 124 in the downhole direction.

The standing injection valve top sub 104 includes a cavity 108, into which gas or fluid, such as a pressurized diluent, can be delivered from an uphole source through a length of tubing. When the injection valve assembly is in an open position, the top cavity 108, injection valve chamber 118, and hollow interior of the valve head 114 can be in fluid communication. In some aspects, the standing injection valve top sub 104 can optionally include a filter 110 located within the top sub cavity 108, coupled to the top of the injection valve structure. The filter 110 can reduce the chance of plugging elements of the injection valve with pipe scale, pipe dope, or well debris either when testing the valve or when using the valve for diluent injection. In some aspects, the filter 110 can be a porous metal filter.

The injection valve assembly further includes an intermediary valve casing 129, located between and mechanically coupled to the valve head neck 116 and the valve stem casing 122, which can surround at least a portion of the valve stem 120 and can optionally surround a portion of the valve head 114. The intermediary valve casing 129 can further contain at least one dampening system assembly 128 and at least one flow restrictor assembly 130 in positions outward from the valve stem 120 and relatively proximate to the exterior of the standing tube casing 102. The at least one dampening system assembly 128 and at least one flow restrictor assembly 130 can each be in fluid communication with the compression spring chamber 126.

When the injection valve assembly actuates to open, the valve head 114, intermediary valve casing 129, and valve stem 120 all move in a downhole direction, and the compression spring 124 is deflected in the downhole direction. The cross-section of the intermediary valve casing 129 can be equal to the width or diameter of the compression spring chamber, and accordingly, when the injection valve opens, the downhole movement of the intermediary valve casing 129 reduces the volume of the compression spring chamber 126 downhole of the intermediary valve casing 129.

The compression spring chamber 126 can be filled with a hydraulic fluid, thus when the injection valve opens and the volume of the compression spring chamber 126 is reduced, the hydraulic fluid both resists compression and seeks to escape the compression spring chamber 126. The compression spring chamber 126 is in fluid communication with at least one dampening system assembly 128, where the dampening system assembly 128 can include a choke valve that allows for fluid flow in only an uphole direction. The movement of the intermediary valve casing 129 in the downhole direction results in a volume of the compression spring chamber 126 uphole of the intermediary valve casing 129, into which hydraulic fluid can flow via the dampening system assembly 128.

When the injection valve assembly actuates to close, the valve head 114, intermediary valve casing 129, and valve stem 120 all move in an uphole direction, and the compression spring 124 decompresses to restore to its initial set length and tension. The uphole movement of the injection valve assembly, however, can be restricted by hydraulic fluid present in the portion of the compression spring chamber 126 uphole of the intermediary valve casing 129. The portion of the compression spring chamber 126 uphole of the intermediary valve casing 129 can be in fluid communication with a flow restrictor assembly 130, which can allow for flow of the hydraulic fluid from the portion of the compression spring chamber 126 uphole of the intermediary valve casing 129 to the portion of the compression spring chamber 126 downhole of the intermediary valve casing 129. The size and shape of the flow restrictor assembly 130 can control the speed at which hydraulic fluid passes through the flow restrictor assembly 130, and can therefore control the speed at which the injection valve assembly actuates to a closed position.

Spring adjustment threads 132 can be set to adjust the preload force of the compression spring 124 that is coiled around the valve stem 120 and valve stem casing 122. The preload force can correlate to a pressure sufficient to actuate the injection valve to an open position. Such an opening pressure can be calculated by dividing the area of the valve head 114 sealing diameter sufficient to close the opening in the valve seat 112 by the adjusted compression spring 124 load. The opening pressure of the injection valve can be adjusted during manufacture of the standing tube and injection valve with a hydraulically dampened valve closure 100, or at other points before installation and deployment in a wellbore. Once the opening pressure is set, set screws 140 can be tightened to lock the spring adjustment threads 132. In some aspects, spring adjustment threads 132 and corresponding set screws 140 can be located at the uphole end of the standing tube casing 102, located between the interior diameter of the standing tube casing 102 and the outer diameter of the standing tube valve bottom sub 106. In other aspects, spring adjustment threads 132 and corresponding set screws 140 can be located at the downhole end of the standing tube casing 102, located between the interior diameter of the standing injection valve housing 102 and the outer diameter of the standing tube valve top sub 104. In further aspects, spring adjustment threads 132 and corresponding set screws 140 can be located at both the uphole and downhole ends of the standing injection valve housing 102, corresponding to the standing tube top sub and standing tube bottom sub, respectively. In aspects, when the set screws 140 are installed, the tool is able to hold more torque than threads on each end of a connected casing, mandrel, or tool.

In some examples, the preset threshold pressure for an opening pressure and a closing pressure can be the same pressure, or the threshold pressure for the opening pressure can be different than the threshold pressure for the closing pressure. In one example, the preset pressure differential can be about 65 bar (or about 942 psi). A standing injection valve can have a maximum downhole flow capacity of about 500 cubic meters per day to a minimum of 21 cubic meters per day.

Thrust bearings 134 can mechanically couple to the compression spring 124 at the downhole end or uphole end of the compression spring 124 to permit rotation of the compression spring while supporting the axial load of the compression spring 124 during assembly or adjustment of the spring load with the mating components without winding or unwinding the spring or causing frictional damage to the mating components.

In some aspects, the standing injection valve housing 102 can include a relief valve, which can include a relief valve head 136 and a relief valve port 138. Because the compression spring chamber 126 is filled with hydraulic fluid, which can expand due to temperature, a pressure relief valve can be included so that the pressure of the hydraulic fluid in the closed compression spring chamber 126 will leak out if the pressure therein exceeds a preset release pressure of the relief valve. In some aspects, the relief valve can release excess pressure in the compression spring chamber 126 when the pressure within the compression spring chamber 126 is about 3000 psi. Other design configurations can also include one or more balance pistons to replace this pressure relief valve function. The compression spring chamber 126 can be filled with a hydraulic fluid through a hydraulic filling port 142.

The hollow interior of the valve stem 120 can further be in fluid communication with a bottom sub cavity 144 included within the standing tube bottom sub 106. Fluid or gas in the interior of the valve stem 120 can thus be delivered downhole through the bottom sub cavity through tubing through packers and other downhole chambers which contain the ESP intake, further downhole from the injection valve assembly.

Figure 1B:
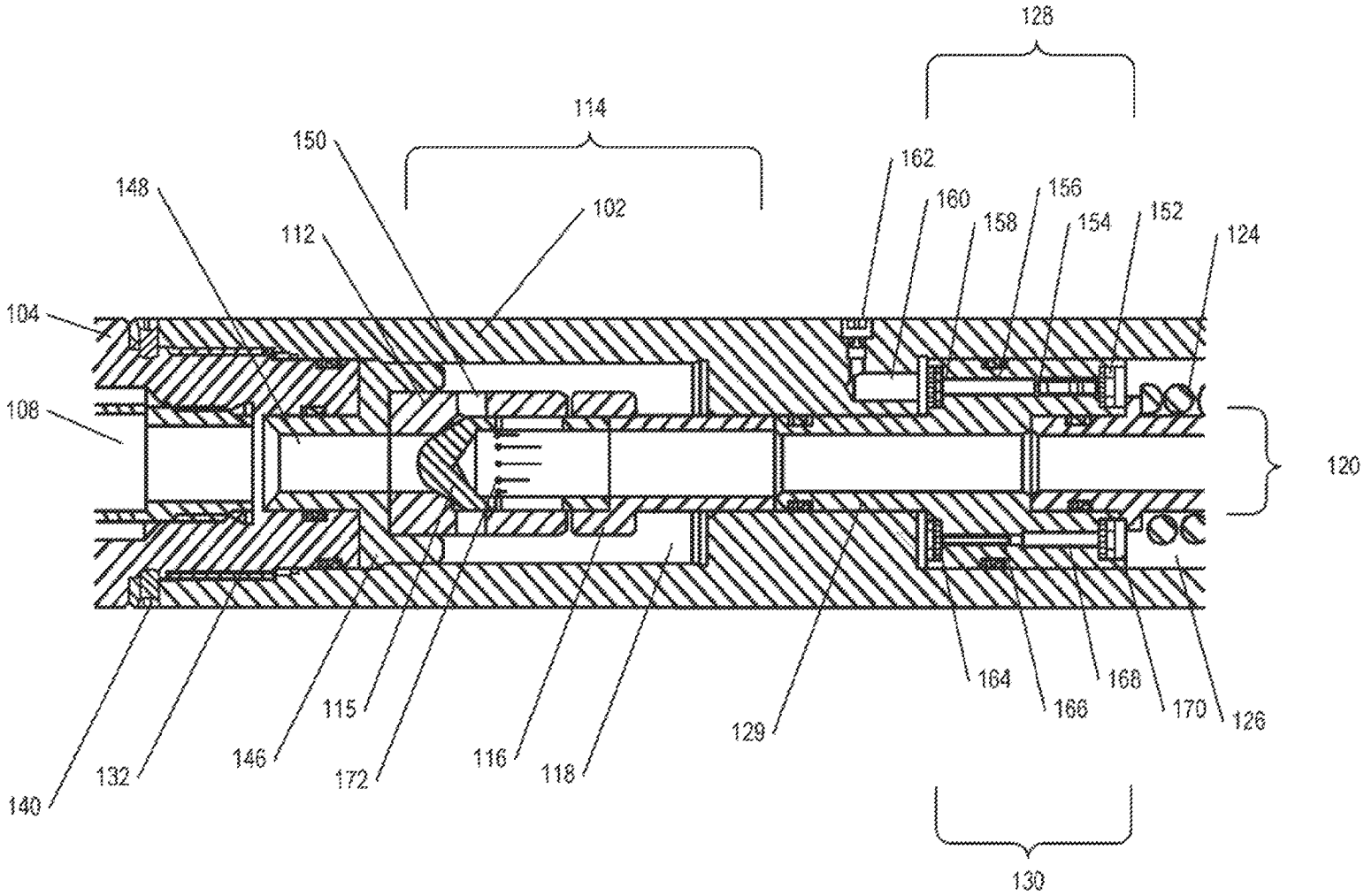
FIG. 1B is a cross-sectional schematic representing a section of the standing injection valve and the hydraulically dampened valve closure represented in FIG. 1A, where the valve is in a closed position, according to some aspects of the present disclosure.

FIG. 1B is a cross-sectional schematic representing a detail section of the injection valve and a hydraulically dampened valve closure represented in FIG. 1A, where the valve is in a closed position, particularly in a fully closed position. As can be seen in further detail in FIG. 1B, a dampening system assembly 128 housed within the intermediary valve mandrel 129 can include a dampening inflow filter port 152, a check valve 154, a dampening system channel 156, and a dampening outflow filter port 158. The dampening inflow filter port 152 can allow hydraulic fluid from the compression spring chamber 126 to enter a conduit channel of dampening system assembly 128, filtering out wear debris or other particulate matter that can potentially block the flow of fluids through the flow restrictor 130. The check valve 154 allows free passage of hydraulic fluid through the dampening system assembly 128 in only the uphole direction. Hydraulic fluid can exit the dampening system channel 156 through the dampening outflow filter port 158. Thus, the dampening system assembly 128 provides for fluid communication between a region of the compression spring chamber 126 downhole of the intermediary valve casing 129 to the region of the compression spring chamber 126 uphole of the intermediary valve casing 129.

In some aspects, a region of the compression spring chamber 126 uphole of the intermediary valve housing 129 can be fluidly connected to a supplementary cavity 160 positioned generally parallel to, but relatively outward from, the valve stem 120. The supplementary cavity 160 can be fluidly connected to an upper plug 162 on the exterior surface of the standing tube casing 102. The upper plug 162 is removed during filling of the hydraulic chamber so that all of the entrapped air can be bled from the hydraulic system so it can be completely filled with hydraulic fluid. In some aspects, the upper plug 162 can provide for an additional hydraulic filling port similar to the hydraulic filling port 142. In other aspects, the upper plug 162 can provide for a pressure relief outlet, to leak out hydraulic fluid from the compression spring chamber 126.

Hydraulic fluid in the region of the compression spring chamber 126 uphole of the intermediary valve housing 129 can be directed back into the region of the compression spring chamber 126 downhole of the intermediary valve casing 129 through the flow restrictor assembly 130 housed within the intermediary valve casing 129. The flow restrictor assembly 130 can include a restrictor inflow filter port 164, a flow restrictor 166, a restrictor channel 168, and a restrictor outflow filter port 170. Hydraulic fluid that enters the restrictor inflow filter port 164 is directed into the flow restrictor 166. The flow restrictor 166 can have a passage diameter that limits the amount of fluid that can pass through its passage. In aspects, the flow restrictor can be an extended passage structure, bending, turning, or coiling to increase the length of the flow restrictor 166, and thereby increase the amount of time required for fluid to pass through the flow restrictor 166. Optionally, the flow restrictor assembly 130 can include a restrictor channel 168 through which fluid from the flow restrictor 166 passes before exiting the flow restrictor assembly 130 via the restrictor outflow filter port 170. In other aspects, the flow restrictor 166 can include a spin chamber, a turbulent flow path, or other structure to limit the rate of hydraulic fluid flow through the flow restrictor. In some aspects, a choke valve can be located in the region of the restrictor channel 168 to allow the passage of fluid only in the downhole direction. Thus, the flow restrictor assembly 130 provides for fluid communication between a region of the compression spring chamber 126 uphole of the intermediary valve casing 129 to the region of the compression spring chamber 126 downhole of the intermediary valve casing 129.

As can be seen in further detail in FIG. 1B, the valve head 114 has valve head openings 172 that allow for fluid communication between the interior of the valve head 114 and the injection valve chamber 118. When in a closed position, the valve head 114, rests coupled to the valve seat 112. Further, the valve seat 112 is mounted within a valve bonnet 146, which is mechanically coupled to both the standing tube casing 102 and the standing tube valve top sub 104. The valve bonnet 146 has a bonnet cavity 148 in fluid communication with the top sub cavity 108, where the bonnet cavity 148 can direct gas or fluid toward valve seat openings 150. The valve seat openings 150 provide for, when the injection valve assembly is in an open position, fluid communication between the interior of the valve seat and the injection valve chamber 118.

As the valve head 114 moves in a downhole direction, valve head openings 172 are progressively exposed to the space of the injection valve chamber 118, thereby providing a path of fluid communication between the interior of the valve head 114 and the injection valve chamber 118. The valve head openings 172 perforating the valve head 114 can have several configurations or arrangements. As illustrated in FIG. 1B, the valve head openings 172 are a combination of slit and circular hole apertures in the valve head 114, generally in the valve head nose 115 region of the valve head 114. The valve head openings 172 that are slits can extend along the length of the valve head nose 115, where the portion of the slits distal from the uphole end of valve head nose 115 are the first portions of the valve head openings 172 to be exposed to injection valve chamber 118. In aspects, the valve head openings 172 are narrower or smaller distal from the uphole end of valve head nose 115. In some aspects, the valve head openings 172 can have a minimum width or diameter of 1/32 inches. The distal from the uphole end of valve head nose 115 can widen or become larger proximate from the uphole end of valve head nose 115. Accordingly, as the injection valve assembly opens, and the valve head 114 moves in a downhole direction, the area of valve head openings 172 through which fluid can flow increases. Moreover, in some aspects, the area of valve head openings 172 through which fluid can flow increases at a greater than linear rate due to either or both of the increased size and number of valve head openings 172 proximate to the uphole end of valve head nose 115.

Figure 1C:
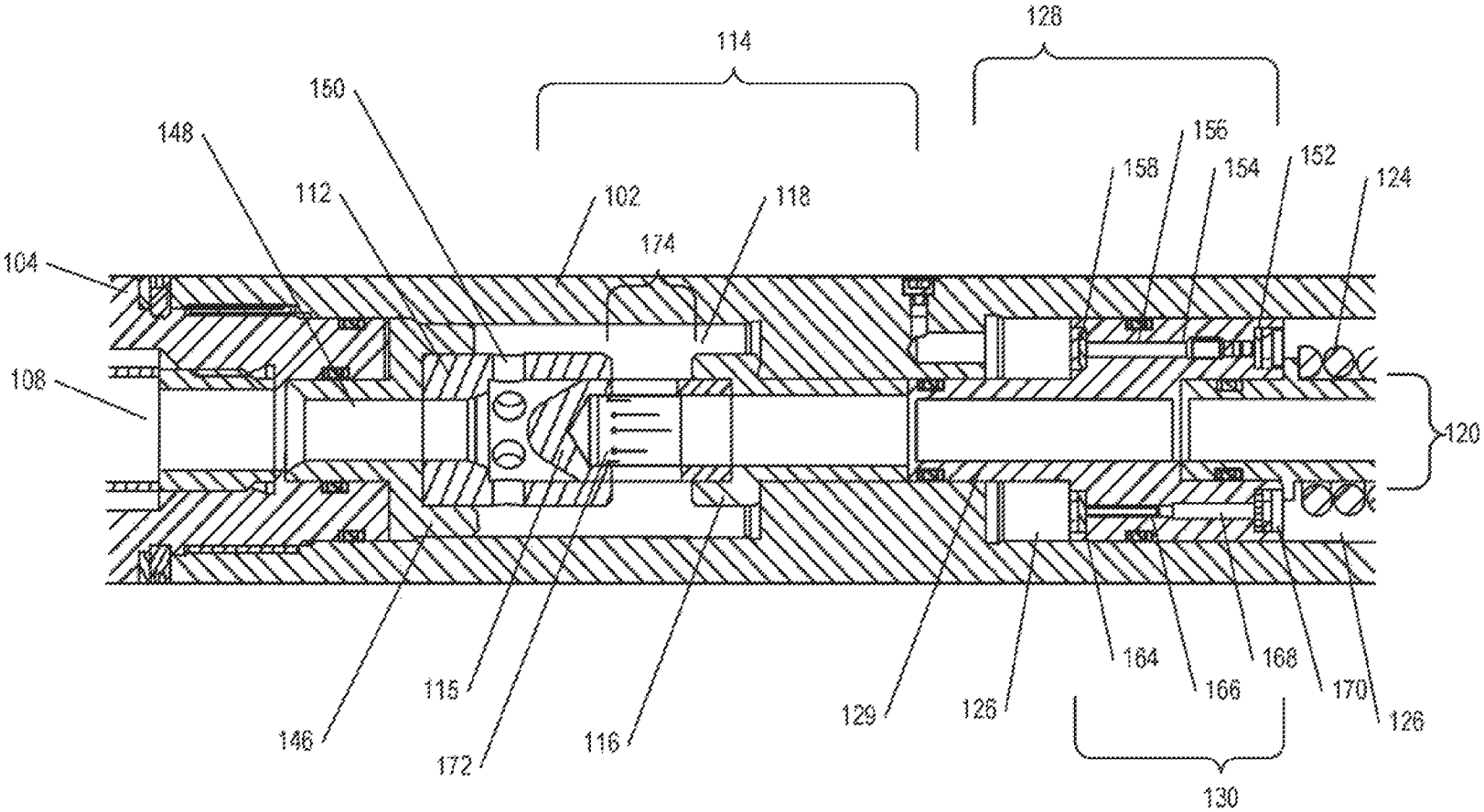
FIG. 1C is a cross-sectional schematic representing a section of the standing injection valve and the hydraulically dampened valve closure represented in FIG. 1A, where the valve is in an open position, according to some aspects of the present disclosure.

FIG. 1C is a cross-sectional schematic representing a detail section of the injection valve and a hydraulically dampened valve closure represented in FIG. 1A, where the valve is in an open position, and more particularly in a fully open position. As can be seen in further detail in FIG. 1C, the compression spring chamber 126 can have a region uphole of the intermediary valve casing 129 and a region downhole of the intermediary valve casing 129 when the injection valve assembly is actuated in an open position. Hydraulic fluid can be present in both uphole and downhole regions of the compression spring chamber 126 when the injection valve assembly is open. Also seen in further detail is the path of fluid communication between the top sub cavity 108, the bonnet cavity 148, the injection valve chamber 118, and interior volume of the valve head 114, and the interior volume of the valve stem 120.

The distance that the valve head 114 moves from a fully closed position to a fully open position defines the stroke length 174 of the injection valve assembly. The stroke length 174 can be controlled by any or a combination of the length of the injection valve chamber 118 in the longitudinal axis of the standing tube casing 102, the shape and size of the valve head neck 116 and how the valve head neck 116 interfaces with the housing 102, and the shape and length of the valve head nose 115. In aspects, a longer the stroke length 174 of the injection valve assembly corresponds with a larger potential region of the compression spring chamber 126 uphole of the intermediary valve casing 129, and thus a greater amount of hydraulic fluid volume that can resist against the closing of the injection valve assembly. The larger stroke length 174 can therefore increase the amount of time needed to actuate the injection valve assembly to a closed position.

Figure 2A:
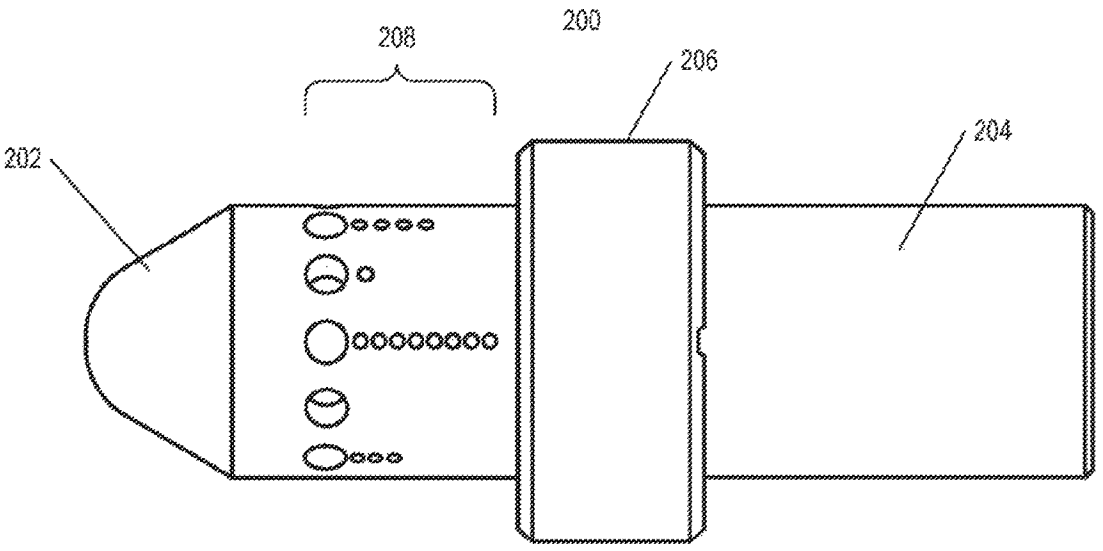
FIG. 2A is a schematic representing an alternative example of a poppet valve head, according to some aspects of the present disclosure.
Figure 2B:
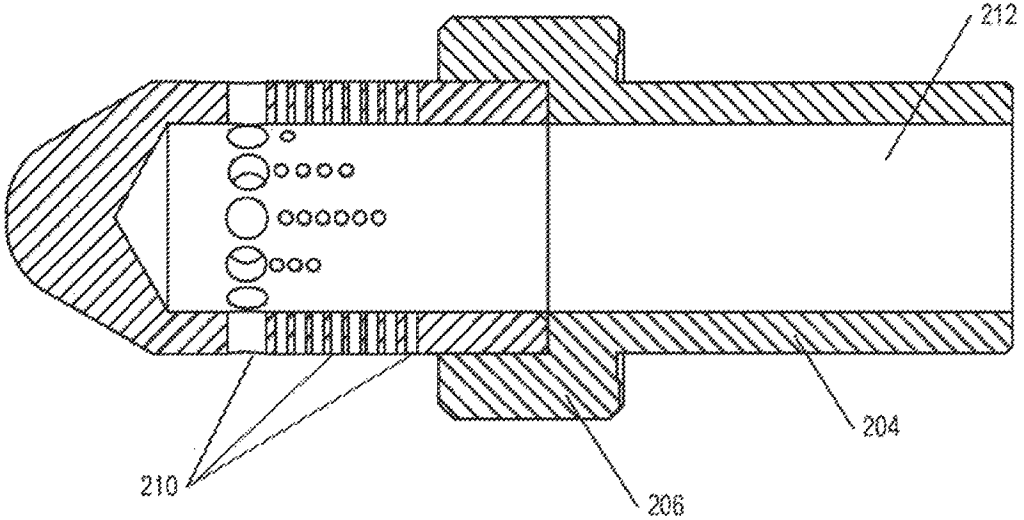
FIG. 2B is a cross-sectional schematic representing the poppet valve head as shown by FIG. 2A, according to some aspects of the present disclosure.

FIG. 2A is a schematic representing an alternative example of a poppet valve head 200 with a configuration of valve head apertures. The poppet valve head 200 can be constructed of distinct portions, particularly a valve head nose 202, a valve head neck 204, and a valve head shoulder 206. The valve head nose 202 is at least in part perforated with an arrangement or configuration of openings in a valve head aperture region 208. FIG. 2B is a cross-sectional schematic representing the poppet valve head 200 with a configuration of valve head apertures of FIG. 2A, further indicating individual valve head apertures 210 and a valve head interior volume 212.

In aspects, the valve head apertures 210 are circular, and can have a larger diameter proximate to the uphole end of the valve head nose 202. Multiple valve head apertures 210 can extend or be spread across the valve head aperture region 208 different lengths, symmetrically or asymmetrically. In some aspects, the number of valve head apertures 210 can be fewer in the portion of the valve head aperture region 208 proximate to the valve head shoulder 206, compared to the number of valve head apertures 210 in the portion of the valve head aperture region 208 distal from the valve head shoulder 206. In other aspects, the size of valve head apertures 210 can be smaller in the portion of the valve head aperture region 208 proximate to the valve head shoulder 206, compared to the size of valve head apertures 210 in the portion of the valve head aperture region 208 distal from the valve head shoulder 206. Accordingly, the amount of potential fluid flow though the poppet valve head 200 and valve head interior volume 214 is regulated by and proportional to the area of valve head apertures 210 exposed to an injection valve chamber.

Figure 3A:
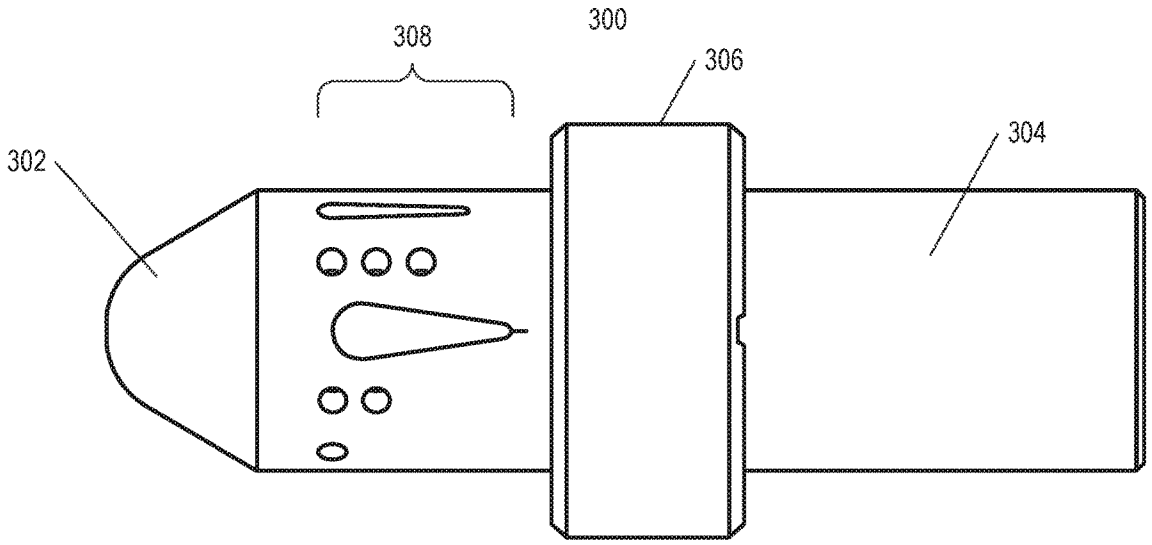
FIG. 3A is a schematic representing an embodiment of a poppet valve head, according to some aspects of the present disclosure.
Figure 3B:
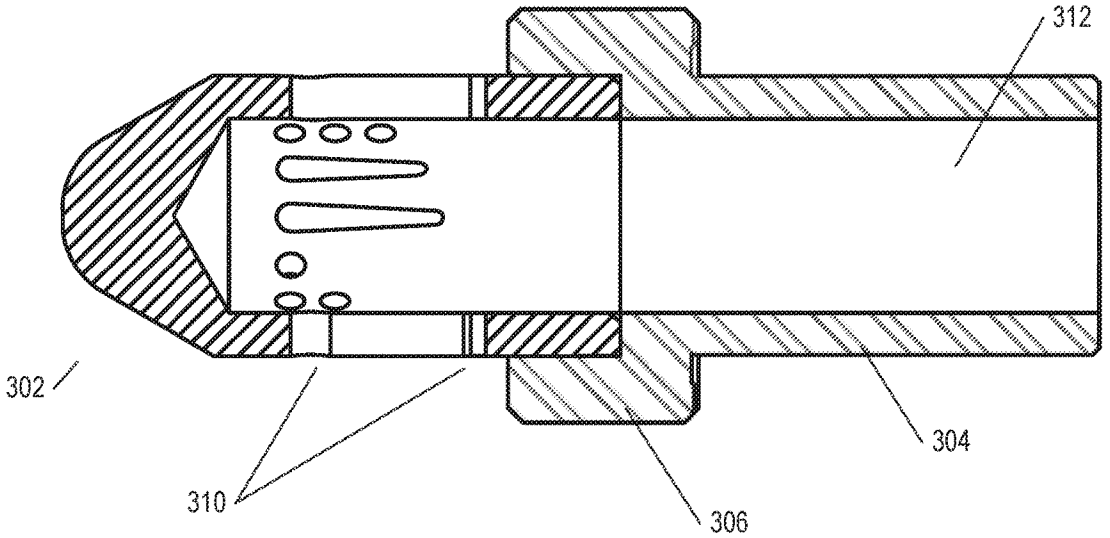
FIG. 3B is a cross-sectional schematic representing the poppet valve head as shown by FIG. 3A, according to some aspects of the present disclosure.

FIG. 3A is a schematic representing an alternative example of a poppet valve head 300 with a configuration of valve head apertures. The poppet valve head 300 can be constructed of distinct portions, particularly a valve head nose 302, a valve head neck 304, and a valve head shoulder 306. The valve head nose 302 is at least in part perforated with an arrangement or configuration of openings in a valve head aperture region 308. FIG. 3B is a cross-sectional schematic representing the poppet valve head 300 with a configuration of valve head apertures of FIG. 3A, further indicating individual valve head apertures 310 and a valve head interior volume 312.

In aspects, the valve head apertures 310 can be a combination of circular and elongate shapes, and can have a larger diameter or width proximate to the uphole end of the valve head nose 302. Multiple valve head apertures 310 can extend or be spread across the valve head aperture region 308 different lengths, symmetrically or asymmetrically. In some aspects, the number of valve head apertures 310 can be fewer in the portion of the valve head aperture region 308 proximate to the valve head shoulder 306, compared to the number of valve head apertures 310 in the portion of the valve head aperture region 308 distal from the valve head shoulder 306. In other aspects, the size of valve head apertures 310 can be smaller in the portion of the valve head aperture region 308 proximate to the valve head shoulder 306, compared to the size of valve head apertures 310 in the portion of the valve head aperture region 308 distal from the valve head shoulder 306. Accordingly, the amount of potential fluid flow though the poppet valve head 300 and valve head interior volume 314 is regulated by and proportional to the area of valve head apertures 310 exposed to an injection valve chamber.

Figure 4A:
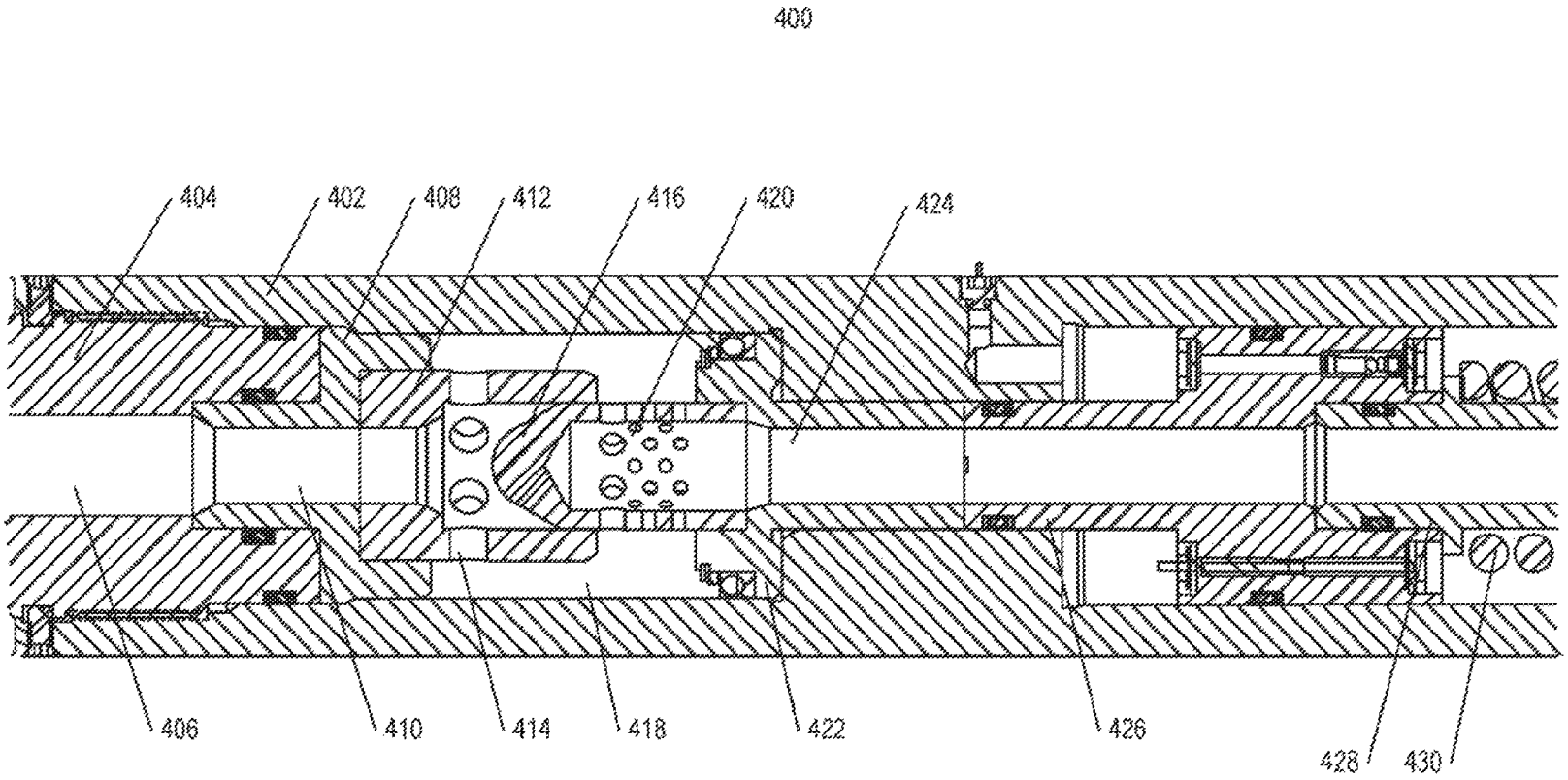
FIG. 4A is a cross-sectional schematic representing a section of an injection valve having a hydraulically dampened valve closure, having an alternative example of a poppet valve head, where the valve is in an open position, according to some aspects of the present disclosure.

FIG. 4A is a cross-sectional schematic representing a detail section of an injection valve and a hydraulically dampened valve closure, having an alternative example of a poppet valve head, where the valve is in an open position 400. As in other configurations, a standing tube casing 402 is mechanically coupled to a standing tube top sub 404 which has a top sub cavity 406. In such aspects, the standing tube top sub 404 does not include a filter within the top sub cavity 406. A valve bonnet 408 is mechanically coupled to both the standing tube casing 402 and the top sub 404, where the valve bonnet 408 has a bonnet cavity 410 in fluid communication with the top sub cavity 406. The valve bonnet 408 is mechanically coupled to and mounts a valve seat 412, which has valve seat openings 414 that are in fluid communication with the bonnet cavity 410. The valve seat openings 414 can be open to an injection valve chamber 418 when a valve head nose 416 is in an open position, i.e. shifted in a downhole position, such that the valve head nose 416 does not block the flow path through the valve seat openings 414. The valve head further has a valve head aperture region 420 with openings to allow for flow and fluid communication between the injection valve chamber 418 and a valve head interior volume 424. The valve head can include a valve head neck 422 mechanically coupled to the standing tube casing 402 and in contact with an intermediary valve casing 426. The intermediary valve casing 426 is further mechanically coupled to a valve stem 428, where the valve stem 428 is coiled by and pushed in an uphole direction by a compression spring 430.

In aspects, the valve head apertures in the valve head aperture region 420 can be circular, and can have larger diameters proximate to the uphole end of the valve head nose 416. The valve head apertures can extend or be spread across the valve head by different lengths, symmetrically or asymmetrically. In some aspects, the number of valve head apertures can be fewer in the portion of the valve head aperture region 420 proximate to the intermediary valve casing 426, compared to the number of valve head apertures in the portion of the valve head aperture region 420 distal from the intermediary valve casing 426. In other aspects, the size of valve head apertures can be smaller in the portion of the valve head aperture region 420 proximate to the intermediary valve casing 426 as compared to the size of valve head apertures in the portion of the valve head aperture region 420 distal from the intermediary valve casing 426. Accordingly, the amount of potential fluid flow though the valve head and valve head interior volume 424 is regulated by and proportional to the area of valve head apertures exposed to the injection valve chamber 418.

Figure 4B:
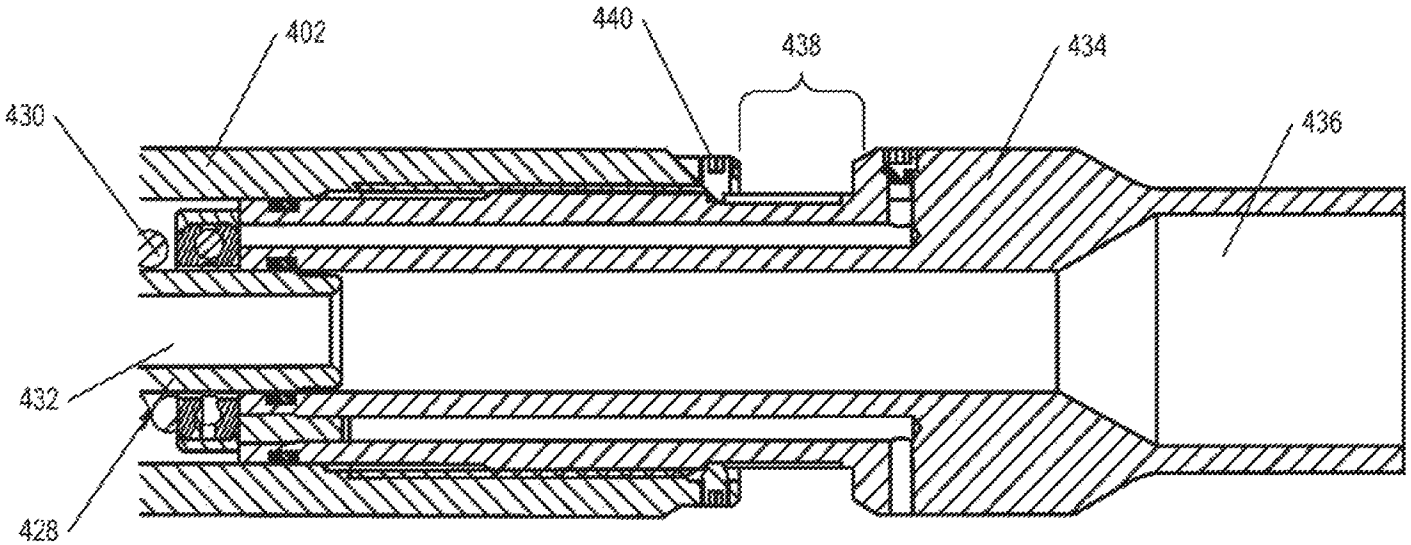
FIG. 4B is a cross-sectional schematic representing a section of an injection valve as in FIG. 4A, at the interface between a valve stem, standing tube casing, and standing tube bottom sub, according to some aspects of the present disclosure.

FIG. 4B is a cross-sectional schematic representing a detail section of an injection standing valve at the interface between a valve stem mandrel 428, the housing 402, and bottom sub 434. The valve stem mandrel 428 has a valve stem interior volume 432, where the valve stem is mechanically coupled to the bottom sub 434 having a bottom sub 436, such that the valve stem mandrel interior volume 432 and bottom sub pin cavity 436 are in fluid communication. In aspects, the housing 402 can be an offset distance 438 from a portion of the standing tube bottom sub 434. The offset distance 438 can be variable, where the offset distance 438 can change the volume of a compression spring chamber (and the closed spring load) in the interior of the standing tube casing 402. In aspects, the standing tube casing 402 can be secured to a surface of the bottom 434 with set screws 440, and thereby set the offset distance 438.

Figure 5:
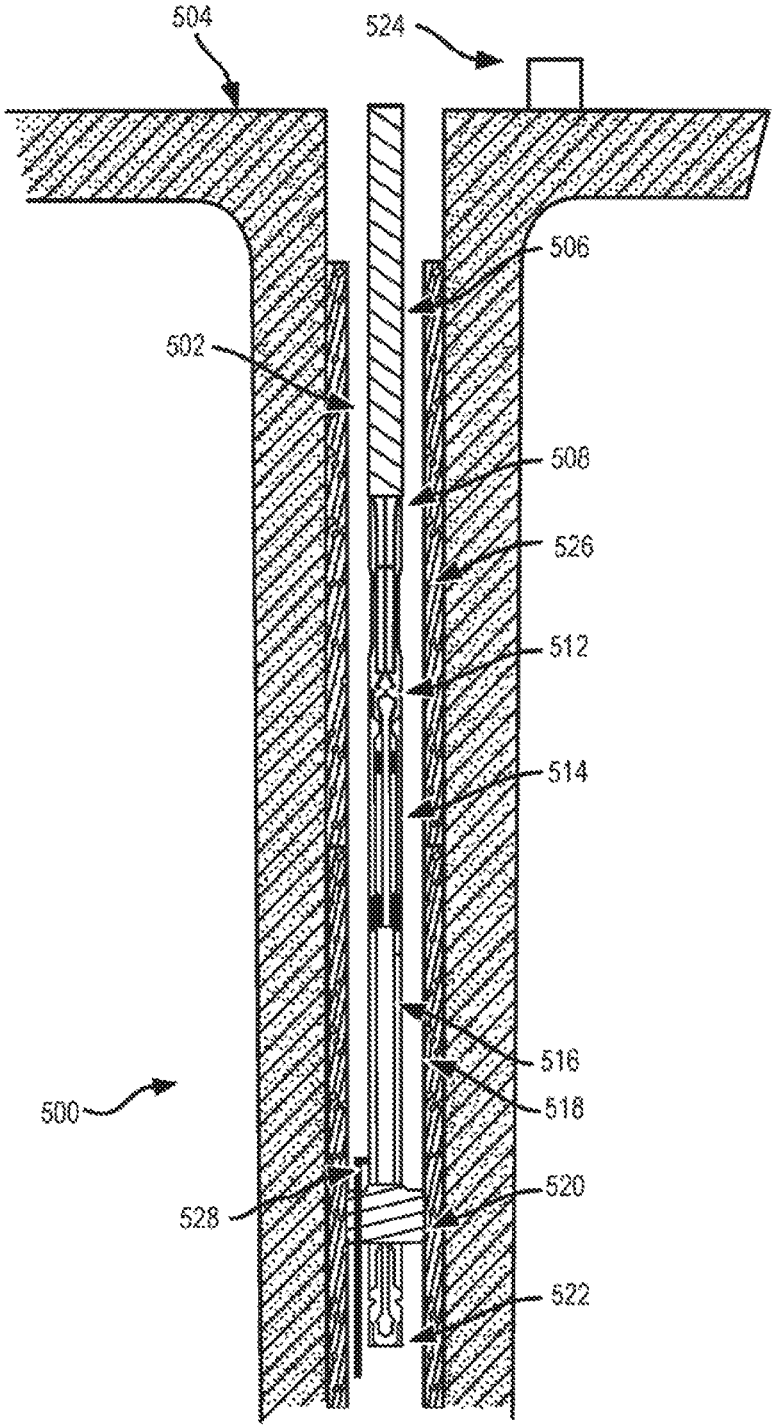
FIG. 5 is a schematic diagram of an example of a well system in which an injection valve having hydraulically dampened valve closure can be deployed, which can include an electric submersible pump (ESP) deployed downhole of the injection valve, according to some aspects of the present disclosure

FIG. 5 is a schematic diagram of an example of a well system 500 in which a standing injection valve having hydraulically dampened valve closure 512 can be deployed, which can further include an ESP 522 deployed downhole of the injection valve having hydraulically dampened valve closure 512. The well system 500 includes a wellbore 502 extending through various earth strata. In some aspects, the wellbore 502 can be at least partially walled or encased by a cement layer 526, which can further in part define a downhole casing region 518. The wellbore 502 extends through a hydrocarbon bearing subterranean formation. A casing string 506 extends from the surface 504 to the subterranean formation. The casing string 506 can provide a conduit via which formation fluids, such as production fluids produced from the subterranean formation, can travel from the wellbore 502 to the surface 504. Conversely, the casing string 506 can also provide a conduit via which processing fluids, such as pressurize diluent fluids or gases produced, can travel from the surface 504 to the wellbore 502 and into production fluids produced from the subterranean formation, where in aspects processing fluids can further pass through the injection valve having hydraulically dampened valve closure 512.

The well system 500 can include at least one standing injection valve having hydraulically dampened valve closure 512. The standing injection valve having hydraulically dampened valve closure 512 is coupled to a first length of diluent injection tubing 508, which in aspects can be held within the casing string 506, from the surface 504. The standing injection valve having hydraulically dampened valve closure 512 can further be fluidically coupled to either or both of a pressurized gas and pressurized fluid source (not shown) at the surface 504 of the well system 500. A second length of tubing 516 extends from the bottom of the standing injection valve 512 and valve stem region 514, passes through a packer 520 to inject diluent in chamber or region near the ESP 522 input. In some aspects, some or all of the second length of tubing 516 can be held within the downhole casing region 518, which in further aspects can be an extension of the casing string 506. The well system 500 can include at least one ESP 522 that can draw diluent fluid from the second length of tubing 516 coupled to the hydraulically dampened valve closure 512. In aspects, an injection line 528 can provide a path of fluid communication, passing through the packer 520, between the second length of tubing 516 and the region near the ESP 522, in order to deliver diluent fluid. In aspects, the ESP 522 can include a controller for controlling operations of the ESP 522. The ESP 522 can be communicatively coupled to a control unit 524 at the surface of the well system 500. A non-limiting example of a control unit 524 is a computing device such as desktop computer or other suitable computing device having either or both of wired and wireless communicative connections. The control unit 524 can process data received from the controller located at the ESP 522, and control flow of pressurized fluids or gases to the hydraulically dampened valve closure 512 based on the data received from the controller.

The subject matter of aspects and examples of this patent is described here with specificity to meet statutory requirements, but this description is not necessarily intended to limit the scope of the claims. The claimed subject matter may be embodied in other ways, may include different elements or steps, and may be used in conjunction with other existing or future technologies. Throughout this description for the purposes of explanation, numerous specific details are set forth in order to provide a thorough understanding of examples and aspects of the subject matter disclosed herein. It will be apparent, however, to one skilled in the art that the many examples or aspects may be practiced without some of these specific details. In some instances, well-known structures and devices are shown in diagram or schematic form to avoid obscuring the underlying principles of the described examples or aspects. This description should not be interpreted as implying any particular order or arrangement among or between various steps or elements except when the order of individual steps or arrangement of elements is explicitly described.

The foregoing description of the disclosure, including illustrated aspects and examples has been presented only for the purpose of illustration and description and is not intended to be exhaustive or to limit the disclosure to the precise forms disclosed. Numerous different modifications, adaptations, and arrangements of the components depicted in the drawings or described above, as well as components and steps not shown or described, are possible. Similarly, some features and subcombinations are useful and may be employed without reference to other features and subcombinations. Examples and aspects of the subject matter have been described for illustrative and not restrictive purposes, and alternative examples or aspects will become apparent to those skilled in the art without departing from the scope of this disclosure. Accordingly, the present subject matter is not limited to the examples or aspects described above or depicted in the drawings, and various embodiments, examples, aspects, and modifications can be made without departing from the scope of the claims below.

That which is claimed is:

1. An injection valve assembly for use in a well, comprising:

a standing tube casing having an injection valve chamber and a compression spring chamber;

a valve seat and a valve head located in the injection valve chamber, the valve seat being for mechanically coupling with the valve head, and the valve head being moveable perpendicular relative to the valve seat to reversibly decouple from the valve seat, wherein the valve head includes a valve head nose and a valve head aperture region that has a plurality of elongate valve head apertures having a first width proximate to the valve head nose and a second width distal from the valve head nose, wherein the second width is narrower than the first width and wherein the width of the aperture has a linear taper from the first width to the second width;

an intermediary valve mandrel located in part within the compression spring chamber and mechanically coupled to the valve head, and housing a dampening system assembly and a flow restrictor assembly;

a valve stem mechanically coupled to the intermediary valve mandrel, the valve stem being located in and extending through the compression spring chamber; and a compression spring coiled around the valve stem for applying a force to push the valve head to couple with the valve seat.

2. An injection valve assembly according to claim 1, further comprising a plurality of circular valve head apertures arranged in combination with the plurality of elongate valve head apertures.

3. An injection valve assembly according to claim 1, further comprising:

a standing tube bottom sub mechanically coupled to a downhole end of the standing tube casing; and a downhole spring adjustment thread located between an external surface of the standing tube bottom sub and an interior surface of the standing tube casing, where the downhole spring adjustment thread can be set to adjust a preload force of the compression spring.

4. An injection valve assembly according to claim 1, further comprising:

a standing tube top sub mechanically coupled to an uphole end of the standing tube casing; and an uphole spring adjustment thread located between an external surface of the standing tube top sub and an interior surface of the standing tube casing, where the uphole spring adjustment thread can be set to adjust a preload force of the compression spring.

5. An injection valve assembly according to claim 1, wherein the dampening system assembly further comprises a check valve that allows a flow of a fluid in only a uphole direction.

6. An injection valve assembly according to claim 1, wherein the flow restrictor assembly further comprises a bending flow path, a coiling flow path, a turbulent flow path, a spin chamber, or any combination thereof.

7. An injection valve assembly according to claim 1:

wherein the compression spring chamber is filled with a hydraulic fluid, wherein the valve seat has a valve seat interior volume, wherein the plurality of elongate valve head apertures being exposed to the injection valve chamber allows for fluid communication between the injection valve chamber and a valve head interior volume, wherein the intermediary valve mandrel has an intermediary valve interior volume in fluid communication with the valve seat interior volume, the dampening system assembly and the flow restrictor assembly both being in fluid communication with the compression spring chamber, and wherein the valve stem has a valve stem interior volume in fluid communication with the intermediary valve interior volume.

8. An injection valve assembly according to claim 7, wherein the valve head is decoupled from the valve seat when a preset differential pressure is applied to the valve head from a fluid in the valve seat interior volume.

9. An injection valve assembly according to claim 7, further comprising a standing tube top sub mechanically coupled to an uphole end of the standing tube casing, the standing tube top sub having a top sub cavity in fluid communication with the valve seat interior volume.

10. An injection valve assembly according to claim 7, further comprising a standing tube bottom sub mechanically coupled to a downhole end of the standing tube casing, the standing tube bottom sub having a bottom sub cavity in fluid communication with the valve stem interior volume.

11. An injection valve assembly for use in a well, comprising:

a standing tube casing having an injection valve chamber and a compression spring chamber;

a valve seat and a valve head located in the injection valve chamber, the valve seat being for mechanically coupling with the valve head, and the valve head being moveable perpendicular relative to the valve seat to reversibly decouple from the valve seat, wherein the valve head includes a valve head aperture region that has a plurality of circular valve head apertures and a plurality of elongate valve head apertures wherein the plurality of elongate valve head apertures extend different lengths relative to a valve head nose along a length of the valve head aperture region, in a downhole direction distal from the valve head nose;

an intermediary valve mandrel located in part within the compression spring chamber and mechanically coupled to the valve head, and housing a dampening system assembly and a flow restrictor assembly; a valve stem mechanically coupled to the intermediary valve mandrel, the valve stern being located n and extending through the compression spring chamber; and a compression spring coiled around the valve stem for applying a force to push the valve head to couple with the valve seat.

12. An injection valve assembly according to claim 11, wherein the plurality of circular valve head apertures and the plurality of elongate valve head apertures are distributed asymmetrically across the valve head aperture region.

13. An injection valve assembly according to claim 11, wherein the plurality of circular valve head apertures and the plurality of elongate valve head apertures are distributed symmetrically across the valve head aperture region.

14. An injection valve assembly according to claim 11, wherein the plurality of circular valve head apertures are arranged in an alternating sequence with the plurality of elongate valve head apertures.

15. An injection valve assembly according to claim 11, further comprising:

a standing tube bottom sub mechanically coupled to a downhole end of the standing tube casing; and a downhole spring adjustment thread located between an external surface of the standing tube bottom sub and an interior surface of the standing tube casing, where the downhole spring adjustment thread can be set to adjust a preload force of the compression spring.

16. An injection valve assembly according to claim 11, further comprising:

a standing tube top sub mechanically coupled to an uphole end of the standing tube casing; and an uphole spring adjustment thread located between an external surface of the standing tube top sub and an interior surface of the standing tube casing, where the uphole spring adjustment thread can be set to adjust a preload force of the compression spring.

17. An injection valve assembly according to claim 11, wherein the dampening system assembly further comprises a check valve that allows a flow of a fluid in only a uphole direction.

18. An injection valve assembly according to claim 11, wherein the flow restrictor assembly further comprises a bending flow path, a coiling flow path, a turbulent flow path, a spin chamber, or any combination thereof.

19. An injection valve assembly according to claim 11:

wherein the compression spring chamber is filled with a hydraulic fluid, wherein the valve seat has a valve seat interior volume, wherein the plurality of valve head apertures being exposed to the injection valve chamber allows for fluid communication between the injection valve chamber and a valve head interior volume, wherein the intermediary valve mandrel has an intermediary valve interior volume in fluid communication with the valve seat interior volume, the dampening system assembly and the flow restrictor assembly both being in fluid communication with the compression spring chamber, and wherein the valve stem has a valve stem interior volume in fluid communication with the intermediary valve interior volume.

20. An injection valve assembly according to claim 19, wherein the valve head is decoupled from the valve seat when a preset differential pressure is applied to the valve head from a fluid in the valve seat interior volume.

21. An injection valve assembly according to claim 19, further comprising a standing tube top sub mechanically coupled to an uphole end of the standing tube casing, the standing tube top sub having a top sub cavity in fluid communication with the valve seat interior volume.

22. An injection valve assembly according to claim 19, further comprising a standing tube bottom sub mechanically coupled to a downhole end of the standing tube casing, the standing tube bottom sub having a bottom sub cavity in fluid communication with the valve stem interior volume.

23. An injection valve assembly according to claim 11, wherein of the plurality of elongate valve head apertures, at least one elongate valve head aperture is arranged closer to the valve head nose than another of the elongate valve head apertures.

* * * * *